US005195320A

United States Patent [19]

Kushnir

[11] Patent Number: 5,195,320

[45] Date of Patent: Mar. 23, 1993

[54] PISTON-CYLINDER ASSEMBLY PARTICULARLY USEFUL IN STIRLING CYCLE MACHINES

[75] Inventor: Mark Kushnir, Rehovot, Israel

[73] Assignee: Ist Engineering, Ltd., Rehovot, Israel

[21] Appl. No.: 794,089

[22] Filed: Nov. 18, 1991

[30] Foreign Application Priority Data

Nov. 23, 1990 [IL] Israel ..... 96453

[51] Int. Cl.[5] ..... F01B 29/10

[52] U.S. Cl. ..... 60/517; 92/82; 92/162 R; 277/23

[58] Field of Search ..... 92/68, 82, 162 R; 60/517; 277/23, 212 FB

[56] References Cited

U.S. PATENT DOCUMENTS

| | | | |
|---|---|---|---|
| 3,667,348 | 6/1972 | Neelen | 60/517 |
| 3,865,015 | 2/1975 | Hakansson | 92/82 |
| 4,381,648 | 3/1983 | Balas, Jr. . | |
| 4,711,091 | 12/1987 | Kawajiri et al. | 60/517 |
| 4,712,378 | 12/1987 | Nakayama . | |
| 4,741,252 | 5/1988 | Harter et al. | 92/103 SD |
| 5,056,419 | 10/1991 | Watanabe et al. | 92/82 |
| 5,085,054 | 2/1992 | Katsuda et al. | 60/517 |
| 5,095,700 | 3/1992 | Bolger | 60/517 |

FOREIGN PATENT DOCUMENTS

| | | | |
|---|---|---|---|
| 0195443 | 8/1987 | Japan | 60/517 |

*Primary Examiner*—Thomas E. Denion
*Attorney, Agent, or Firm*—Benjamin J. Barish

[57] ABSTRACT

A piston-cylinder assembly in which the piston includes two piston heads connected together in spaced relation by a stem and cooperable with two portions of the cylinder, dividing the cylinder into a working chamber on one side of the first piston head between it and the end wall of the cylinder, a drive chamber on the opposite side of the second piston head communicating with the drive, and an intermediate chamber between the working chamber and drive chamber. The first piston head defines a clearance seal with respect to the first portion of the cylinder, and the second portion of the cylinder guides the reciprocatory movements of the piston. The intermediate chamber includes a semi-permeable seal between the cylinder and piston, which seal is permeable by gas but impermeable by liquids, to thereby prevent the passage of liquid from the drive chamber through the intermediate chamber to the working chamber.

15 Claims, 1 Drawing Sheet

PISTON-CYLINDER ASSEMBLY PARTICULARLY USEFUL IN STIRLING CYCLE MACHINES

FIELD AND BACKGROUND OF THE INVENTION

The present invention relates to a piston-cylinder assembly. The invention is particularly useful in Stirling cycle machines, and is therefore described below with respect to this application, but it will be appreciated that the invention could advantageously be used in other applications including piston-cylinder assemblies.

One type of piston-cylinder assembly, commonly used in a Stirling cycle machine, comprises a cylinder, a piston head movable within the cylinder, a drive for effecting relative reciprocatory movements between the piston and cylinder, and a rolling or bellows diaphragm connected between the cylinder and the piston to define an expansible-contractible chamber containing a working gas. The rolling or bellows diaphragm thus forms a dynamic seal preventing the penetration of oil or gas into the expansible-contractible working chamber. However, a disadvantage in this type of construction is that the diaphragm is subjected to a large pressure difference on its opposite faces, which places a tremendous stress on the diaphragm and greatly shortens its useful life. Another disadvantage in such a construction is that the diaphragm produces a relatively large "dead volume" in the working chamber, thereby substantially decreasing assembly.

OBJECTS AND BRIEF SUMMARY OF THE INVENTION

An object of the present invention is to provide a piston-cylinder assembly having advantages in the above respects. Another object of the present invention is to provide a Stirling cycle machine including the novel piston-cylinder assembly.

BRIEF DESCRIPTION OF THE DRAWINGS

According to the present invention, there is provided a piston-cylinder assembly, comprising a cylinder including an end wall, a piston movable within the cylinder, and a drive for effecting relative reciprocatory movements between the piston and cylinder; characterized in that: the piston assembly includes first and second piston heads connected together in spaced relation by a stem and cooperable with first and second portions of the cylinder, dividing the cylinder into a working chamber on one side of the first piston head between it and the end wall of the cylinder, a drive chamber on the opposite side of the second piston head communicating with the drive, and an intermediate chamber between the working chamber and drive chamber; the first piston head defining a clearance seal with respect to the first portion of the cylinder; the second portion of the cylinder guiding the reciprocatory movements of the piston; the intermediate chamber including a semi-permeable seal between the cylinder and piston which seal is permeable by gas but impermeable by liquids, to thereby prevent the passage of liquid from the drive chamber through the intermediate chamber to the working chamber.

A piston-cylinder assembly constructed in accordance with the foregoing features substantially decreases the differential pressure on opposite sides of the semi-permeable seal, which permits the working gas to pass, and thereby substantially increase the useful life of the seal. In addition, the semi-permeable seal, preventing liquid (e.g., oil, in the liquid or vaporized condition) from entering the working chamber, is located in the intermediate chamber, and therefore does not produce a "dead volume" in the working chamber, which would reduce the operating efficiency of the assembly.

According to a further aspect of the invention, there is provided a Stirling cycle machine including a compressor section and an expander section, each including a piston-cylinder assembly constructed as described above and therefore providing the advantages described above.

Further features and advantages of the invention will be apparent from the description below.

DESCRIPTION OF A PREFERRED EMBODIMENT

Figure 1:
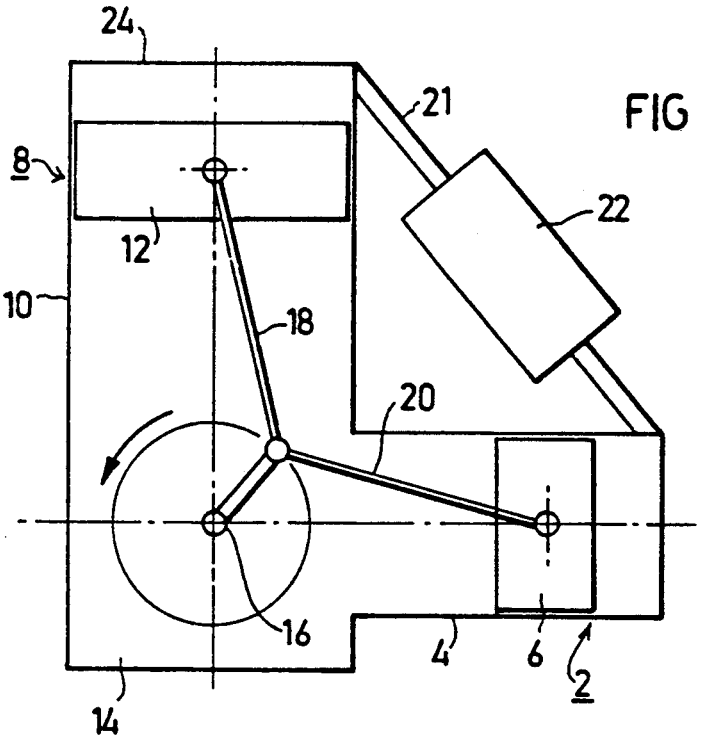
Figure 2:
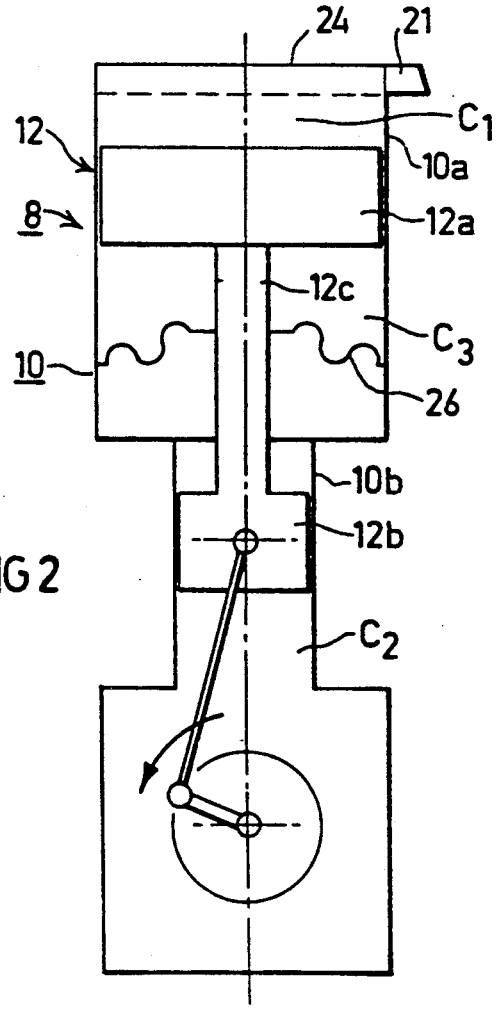

The invention is herein described, by way of example only, with reference to the accompanying drawings, wherein:

FIG. 1 diagrammatically illustrates one form of Stirling cycle machine constructed in accordance with the present invention; and FIG. 2 is an enlarged view illustrating the construction of one section, e.g., the expander section, in the Stirling cycle machine of FIG. 1.

FIG. 1 illustrates one well-known type of Stirling cycle machine, namely the integral construction type. It includes a compressor section 2 comprising a cylinder 4 and a piston 6 reciprocatable therein, and an expander section 8 comprising a cylinder 10 and piston 12 reciprocatable therein. Cylinder 4 of the compressor section 2, and cylinder 10 of the expander section 8, are integrally formed with a crank case 14 enclosing the drive. The drive comprises a crank shaft 16 driven, e.g., by an electric motor (not shown), and coupled by connecting rod 18 and 20 to reciprocate the pistons 6 and 12.

The illustrated Stirling cycle machine includes a working gas flowing via a conduit 21 and regenerator 22 between the compressor section 2 and the expander section 8. Thus, the compression of the working gas in the compressor section 2 heats the gas, and the expansion of the working gas in the expander section 8 cools the gas, so that the outer end wall 24 of the cylinder 10 in the expander section 8 is the coldest part of the illustrated machine. This part 24 is sometimes referred to as the cold tip.

FIG. 2 more particularly illustrates the construction of each section, particularly the expander section 8, in accordance with the present invention.

Thus, as shown in FIG. 2, the expander piston 12 movable within the compressor cylinder 10 includes a first piston head **12*a* cooperable with a first portion 10*a* of the cylinder, and a second piston head 12*b* cooperable with a second portion 10*b* of the cylinder. The two piston heads 12*a*, 12*b* are connected together in spaced relation by a stem 12*c***.

The two piston heads **12*a*, 12*b* and piston stem 12*c* thus divide cylinder 10 into three chambers, as follows: (1) a working chamber $C_1$ on one side of piston head 12*a*, between it and end wall 24 of cylinder 10; (2) a drive chamber $C_2$ on the opposite side of piston head 12*b*, and communicating with the crank case 14 and the drive 16** therein; and (3) an intermediate chamber $C_3$ between working chamber $C_1$ and drive chamber $C_2$.

The intermediate chamber $C_3$ includes a semi-permeable dynamic seal, which is permeable by the working gas (e.g., helium) but impermeable by liquids (e.g., oil, in the liquid or vaporized state). In the embodiment illustrated particularly in FIG. 2, the dynamic seal is in the form of a semi-permeable bellows (or roller) diaphragm 26 connected between the piston stem 12c and the cylinder 10. Preferred materials which may be used for the semi- permeable diaphragm 26 include "Buna-N" rubber or Nitrile rubber.

Piston head 12a is of an outer diameter substantially equal to the inner diameter of section 10a of cylinder 10 so as to define a clearance seal with respect to the cylinder. On the other hand, piston head 12b does not form any seal with respect to cylinder section 10b, but rather the latter section merely guides the reciprocatory movements of the piston head 12b, and thereby of piston head 12a.

The crank case 14 contains lubricating oil, and also the working gas (e.g., helium). The lubricating oil can pass between piston head 12b and cylinder section 10b to lubricate the piston head during its reciprocatory movements. Piston head 12b may be further formed with one or more throughgoing bores 28 to enhance the lubrication of the piston head. Cylinder section 10b and piston head 12b may be of smaller diameter than cylinder section 10a and piston head 12a.

It will thus be seen that the semi-permeable diaphragm 26 will prevent the passage of liquid through the intermediate chamber $C_3$ to the working chamber $C_1$, so that the working chamber, as well as the clearance seal between piston head 12a and cylinder section 10a, will be free of any liquid. On the other hand, the working gas will be permitted to pass through the semi-permeable diaphragm 26 so as to tend to equalize the pressure on the opposite sides of the diaphragm. Accordingly, there will be a very small pressure differential on the opposite sides of the diaphragm, and therefore the diaphragm will not be subject to larger stresses, as in prior art devices, tending to reduce its useful life.

It will also be seen that the diaphragm 26 is located in the intermediate chamber $C_3$, and not in the working chamber $C_1$. Accordingly, it will not produce a "dead volume" in the working chamber $C_1$, as in prior art devices, tending to decrease the overall efficiency of the device.

While the novel piston-cylinder assembly, particularly as illustrated in FIG. 2, is described as part of a Stirling cycle machine, it will be appreciated that such an assembly can be used in many other applications. In addition, while in the illustrated piston-cylinder assembly the cylinder is static, and the piston is reciprocated with respect to the cylinder, it will be appreciated that the invention could also be incorporated in constructions wherein the piston is static, and the cylinder is reciprocated with respect to the piston.

Many other variations, modifications and applications of the invention will he apparent.

What is claimed is:

1. A piston-cylinder assembly, comprising a cylinder including an end wall, a piston movable within said cylinder, and a drive for effecting relative reciprocatory movements between said piston and cylinder; characterized in that:

said piston includes first and second piston heads connected together in spaced relation by a stem and cooperable with first and second portions of the cylinder, dividing the cylinder into a working chamber on one side of said first piston head between it and the end wall of the cylinder, a drive chamber on the opposite side of said second piston head communicating with said drive, and an intermediate chamber between said working chamber and drive chamber;

said first piston head defining a clearance seal with respect to the first portion of the cylinder;

said second portion of the cylinder guiding the reciprocatory movements of the piston;

said intermediate chamber including a semi-permeable seal between the cylinder and piston, which seal is permeable by gas, but impermeable by liquids, to thereby prevent the passage of liquid from the drive chamber through the intermediate chamber to the working chamber.

2. The piston-cylinder assembly according to claim 1, wherein said semi-permeable seal in the intermediate chamber is a semi-permeable diaphragm.

3. The piston-cylinder assembly according to claim 2, wherein said semi-permeable diaphragm is connected between said piston stem and the cylinder.

4. The piston-cylinder assembly according to claim 2, wherein said semi-permeable diaphragm is made of Buna-N or nitrile rubber.

5. The piston-cylinder assembly according to claim 1, wherein said second portion of the cylinder cooperable with said second piston head is of smaller diameter than said first portion of the cylinder cooperable with said first piston head.

6. The piston-cylinder assembly according to claim 1, wherein said second piston head is formed with an opening therethrough permitting liquid oil in said drive chamber to pass into said intermediate chamber and thereby to lubricate said second piston head with respect to said second portion of the cylinder.

7. A piston-cylinder assembly according to claims 1, wherein said cylinder is static, and said piston is reciprocated with respect to said cylinder.

8. A Stirling cycle machine including a compressor section and an expander section, each of said sections including a piston-cylinder assembly according to claim 1.

9. A piston-cylinder assembly, comprising:

a cylinder including an end wall, a piston movable within said cylinder, and a drive for reciprocating said piston within said cylinder;

said piston including first and second piston heads connected together in spaced relation by a stem and cooperable with first and second portions of the cylinder, dividing the cylinder into a working chamber on one side of said first piston head between it and the end wall of the cylinder, a drive chamber on the opposite side of said second piston head communicating with said drive, and an intermediate chamber between said working chamber and drive chamber;

said first piston head defining a clearance seal with respect to the first portion of the cylinder;

said second portion of the cylinder guiding the reciprocatory movements of the piston;

said intermediate chamber including a semi-permeable seal between the cylinder and piston, which seal is permeable by gas, but impermeable by liquids, to thereby prevent the passage of liquid from the drive chamber through the intermediate chamber to the working chamber.

10. The piston-cylinder assembly according to claim 9, wherein said semi-permeable seal in the intermediate chamber is a semi-permeable diaphragm.

11. The piston-cylinder assembly according to claim 10, wherein said semi-permeable diaphragm is connected between said piston stem and the cylinder.

12. The piston-cylinder assembly according to claim 11, wherein said semi-permeable diaphragm is made of Buna-N or nitrile rubber.

13. The piston-cylinder assembly according to claim 9, wherein said second portion of the cylinder cooperable with said second piston head is of smaller diameter than said first portion of the cylinder cooperable with said first piston head.

14. The piston-cylinder assembly according to claim 9, wherein said second piston head is formed with an opening therethrough permitting liquid oil in said drive chamber to pass into said intermediate chamber and thereby to lubricate said second piston head with respect to said second portion of the cylinder.

15. A Stirling cycle machine including a compressor section and an expander section, each of said sections including a piston-cylinder assembly according to claim 9.

* * * * *